United States Patent [19]

Matsumoto et al.

[11] Patent Number: 4,889,052

[45] Date of Patent: Dec. 26, 1989

[54] PAPER FEED CONTROL FOR A DOT-LINE PRINTER

[75] Inventors: Yoshikane Matsumoto; Toshio Hiki; Makoto Kurosawa, all of Ibaraki, Japan

[73] Assignee: Hitachi Koki Company, Limited, Tokyo, Japan

[21] Appl. No.: 124,121

[22] Filed: Nov. 23, 1987

[30] Foreign Application Priority Data

Nov. 21, 1986 [JP] Japan ..... 61-278976

[51] Int. Cl.[4] ..... B41J 3/12

[52] U.S. Cl. ..... 101/93.04; 400/323; 400/568

[58] Field of Search ..... 400/121, 124, 322, 323, 400/328, 568, 902; 101/93.04, 93.05

[56] References Cited

U.S. PATENT DOCUMENTS

| | | | |
|---|---|---|---|
| 4,387,642 | 6/1983 | Bringhurst et al. | 101/93.04 |
| 4,599,007 | 7/1986 | Khorsand | 101/93.04 |

FOREIGN PATENT DOCUMENTS

| | | | |
|---|---|---|---|
| 109671 | 7/1982 | Japan | 101/93.04 |
| 14768 | 1/1983 | Japan | 400/323 |
| 15170 | 1/1985 | Japan | 101/93.04 |
| 183164 | 9/1985 | Japan | 101/93.04 |

OTHER PUBLICATIONS

"Print Hammer Mounting Arrangment for a Matrix Printer", E. G. Lean et al; *IBM Tech. Disc. Bull.,* vol. 27, No. 8, Jul. 1984, pp. 1099–1100.

*Primary Examiner*—David A. Wiecking

*Attorney, Agent, or Firm*—Sughrue, Mion, Zinn, Macpeak & Seas

[57] ABSTRACT

A dot-line printer has a hammer bank carrying a plurality of printing hammers arranged in groups, each group having a predetermined number of printing hammers displaced from one another by predetermined numbers of dot-lines in the direction of paper feed. A shuttle mechanism causes the hammer bank to undergo reciprocating shuttle movements with a reversing period between successive shuttle movements. A character line, covering a predetermined number of dot-lines, is printed over a plurality of shuttle movements, a paper feed mechanism causing the paper to move a predetermined number of dot-lines in the reversing period between shuttle movements. A number of blank dot-lines separate a printed character line from the beginning of the first dot-line of the next character line to be printed. A control mechanism sets the reversing period between successive shuttle movements to be longer than the paper feed time to move the paper to the first dot-line to be printed after the preceding character line has been printed and causes the paper feed to the first dot-line of the next character line to be printed to occur entirely in the reversing period.

3 Claims, 5 Drawing Sheets

PAPER FEED CONTROL FOR A DOT-LINE PRINTER

BACKGROUND OF THE INVENTION

1. Field of the Invention

The present invention relates to a dot-line printer. Such printers have a hammer bank consisting of a plurality of dot-printing hammers separately provided at intervals along a printing line. The hammer bank is reciprocated along the printing line to thereby carry out the printing of characters along the printing line. A space of several dot-lines separates adjacent printed lines of characters.

2. Background of the Invention

FIG. 1 is a schematic of a conventional dot-line printer. The printer includes hammer bank 10 consisting of a plurality of dot-printing hammers 12 juxtaposed along printing positions. Means (not-shown) for driving the printing hammers 12 is reciprocated by a shuttle mechanism 16 along the printing positions parallel to the axial direction of a platen 2. The shuttle mechanism is conventionally a cam, a linear motor or the like. The printing hammers 12 may be any of several known constructions such as, for example, the spring charge type having a leaf spring and a printing pin 14 attached to the upper end of the leaf spring as shown in FIG. 2. The leaf spring is held by a permanent magnet or the like at a non-printing position. When the leaf spring is released it moves paper. As will be made clear hereinafter, the invention, however, is not limited to such a spring charge type printing hammer and any kind of printing hammer may be employed. An ink ribbon 6 is arranged to run between the platen 2 and the hammer bank 10 along the printing positions. The paper 8 to be printed is fed between the platen 2 and the ink ribbon 6 in the direction perpendicular to the running direction of the ink ribbon 6 by means of a pair of paper feed tractors.

Printing is carried out by driving desired printing hammers 12 while the hammer bank 10 is reciprocated. The reciprocation that is, the forward and backward movement of the hammer bank is called "shuttle movement", and one shuttle movement corresponds to a single forward or backward movement of the hammer bank in the reciprocation process.

The manner in which a dot-line printer prints characters will be explained with reference to FIG. 3. FIG. 3A illustrates the printing of the Chinese character "KAN" by the hammers 12. At the top of FIG. 3A is illustrated two adjacent printing pins 14 and 14' separated by an interval of 0.15 inches. The left printing pin 14 is moved right by the shuttle movement of the hammer bank 10 so as to carry out printing in the region bounded on the right by the illustrated position of the right printing pin 14'. Similarly, the right printing pin 14' carries out printing in a region beginning to the right of printing pin 14'.

A matrix having 1/180-inch vertical and horizontal intervals shows points on which the printing pins 14 carry out printing. Hereinafter, the horizontal and vertical positions are referred to as dot-positions and dot-lines, respectively. In the horizontal direction, each of the printing pins 14 carries out printing on the matrix from the first dot-position to the 27th dot-position. In the vertical direction, one printed line is usually 1/6 inches wide, so that the first printed line is comprised of the first dot-line to the 30th dot-line. Printed lines each having 30 dot-lines are successively printed. In the case of printing characters, printing is carried out from the first dot-line to the 24th dot-line of the 30th dot-lines for printing a character line. The portions from the 25th dot-line to the 30th dot-line are defined as the interline space and contain no printing.

FIG. 3B shows the locus of points drawn by a printing pin 14 on the paper 8 in response to the reciprocation of the hammer bank 10 and the paper feed movement. In FIG. 3B, the lefthand numerals represent the shuttle movement number in the printing of each line, and the righthand numerals represent the number of dot-lines printed during the shuttle movement. Printing is actually carried out in a printing period of each shuttle movement. During the printing period the paper 8 is stationary. No printing occurs in a shuttle direction reversing period. However, during the shuttle direction reversing period paper 8 is fed to the next dot-line.

As is apparent from FIGS. 3A and 3B, the hammer bank 10 performs shuttle movement 24 times to print 24 dot-lines from the first dot-line to the 24th dot-line. During the 25th shuttle movement no printing occurs and the paper is fed over 7 dot-lines from the 25th dot-line to the printing start position (i.e., dot-line) of the next character line; that is, to the first dot-line of the second character line. The time necessary to feed the paper 8 over 7 dot-lines is longer than the time necessary to feed the paper one dot-line. Therefore, the shuttle direction reversing period between adjacent dot-lines of a character line used to feed the paper one dot-line is too short to feed the paper over 7 dot-lines. For this reason, the 25th shuttle movement is allotted to the time period for feeding the paper over 7 dot-lines. That is, in order to print one character line, 25 shuttle movements are required; 24 shuttle movements for actually printing the character and one shuttle movement for a 7 dot-lines feed.

The period of time in which the dot of the printing hammer 12 can be successively printed; that is, the hammer repeatability, is about 0.5 ms. The time necessary for feeding paper between successive dot-lines is 3 ms. Accordingly, the time required for printing one character line, which includes the paper, feeding time, is about $(0.5\times27+3)\times25=412.5$ ms, so that the printing speed is about 145 lines per minute.

As is apparent from the above description, in order to increase the printing speed, it is necessary to improve the hammer repeatability and to shorten the paper feeding time. In order to improve hammer repeatability and shorten paper feeding time, however, many problems must first be solved so that such improvement is very difficult to effect.

One proposed solution to increasing printing speed involves increasing the number of printing hammers 12. FIG. 4 shows an example of such an arrangement. Two hammer banks 10 are provided on upper and lower stages respectively, such that the printing pins 14 of printing hammers 12 extending from each of the hammer banks 10 are aligned side by side at intervals of 0.075 inches. The amplitude of the shuttle movement of each of the hammer banks 10 becomes ½ of that of the single bank described above. That is, each print hammer covers 14 dot-positions. Accordingly, in this arrangement, the time required for printing one line is about $(0.5\times14+3)\times25=250$ ms, so that the printing speed is about 240 lines per minute. In the arrangement of FIG. 4, one character is printed by two printing pins 14.

In the arrangement of FIG. 4, each of the hammer banks 10 is reciprocated at a very high speed such as about 50 Hz. Since the mass of the reciprocating hammer banks 10 is twice that of the single bank arrangement, the load applied to the shuttle mechanism 16 is increased, thereby increasing vibration and noise. Therefore, disordering of the printed dot-positions occurs to deteriorate the printing quality. Although the rigidity of the shuttle mechanism 16 may be heightened to prevent such disorder from occurring, the strengthening of the shuttle requires that it be large and costly to manufacture.

SUMMARY OF THE INVENTION

It is an object of the present invention to eliminate the disadvantages in the prior art.

It is another object of the present invention to provide a dot-line printer which uses printing hammers, a paper feeding mechanism, and a shuttle mechanism equivalent to those used in the prior art, and in which the printing speed is increased without creating excessive vibration and noise due to increased speed of the shuttle mechanism so that printing quality is not reduced with increased speed.

The inventors have observed that the time selected for one shuttle movement for carrying out paper feed over the several dot-lines between character lines is much longer than the time actually required to carry out the paper feed between character lines when the printer is operating in the multi-dot-lines simultaneous printing method. According to the present invention, the reversing period of the shuttle movement is made longer than the time required for carrying out the paper feed between character lines so that the paper feed between character lines can be carried out in the hammer bank reversing period of the shuttle movement. This procedure eliminates one shuttle movement for merely carrying out the paper feed between line-character lines.

BRIEF DESCRIPTION OF THE DRAWINGS

Above and other objects, features and advantages of the present invention will appear more fully from the following description in conjunction with the accompanying drawings, in which.

PREFERRED EMBODIMENT OF THE INVENTION

Figure 1:
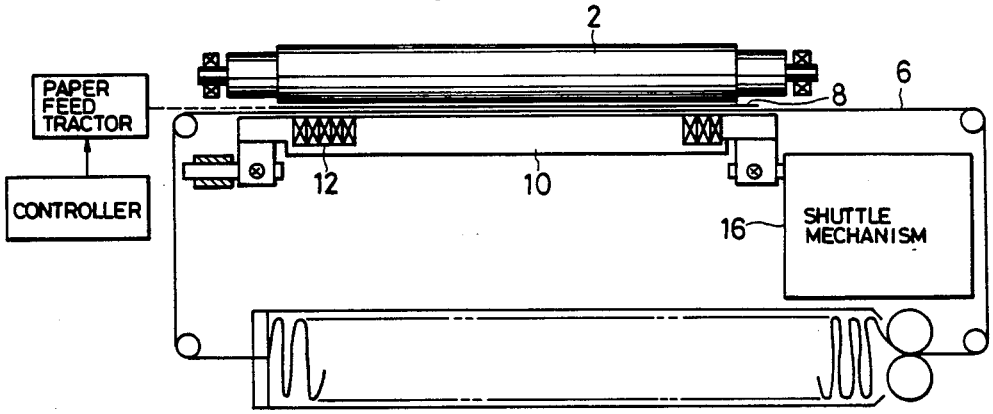
FIG. 1 PRIOR ART
FIG. 1 is a plan view schematic of a dot-line printer.
Figure 2:
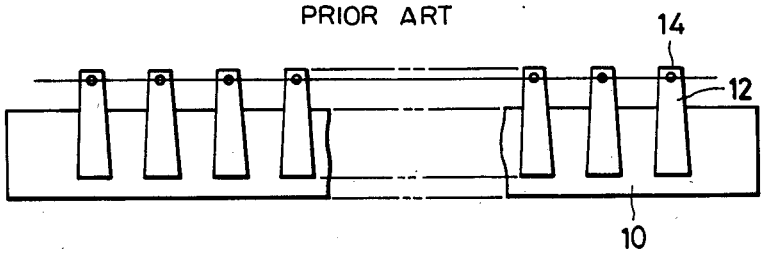
FIG. 2 PRIOR ART
FIG. 2 is a front view of the conventional hammer banks.
Figure 3A:
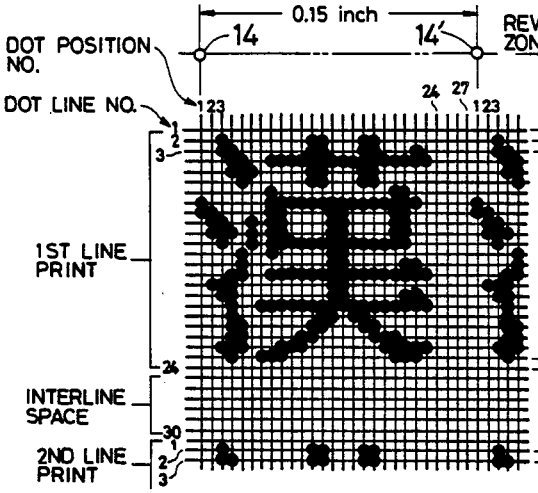
FIG. 3A PRIOR ART
FIG. 3A is a view showing a printed Chinese character "KAN"
Figure 3B:
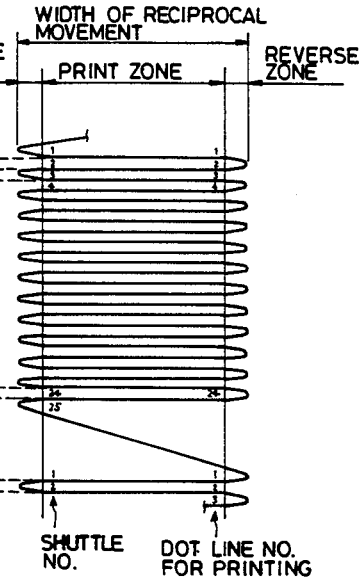
FIG. 3B PRIOR ART
FIG. 3B is a diagram showing a locus of printing pins for explaining the printing system using the hammer bank of FIG. 2.
Figure 4:
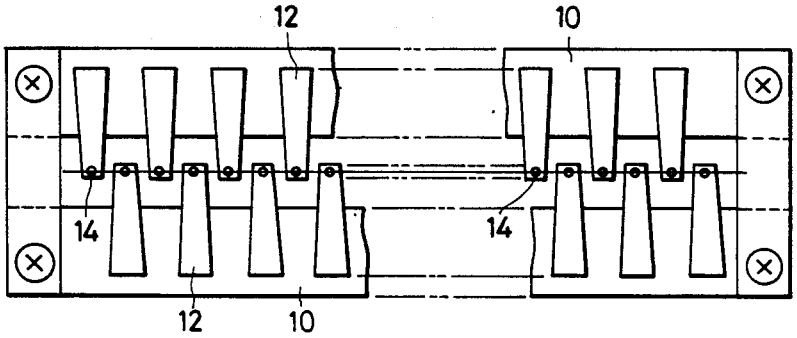
FIG. 4 PRIOR ART
FIGS. 4 and 5 are front views of additional examples of conventional hammer banks.
Figure 5:
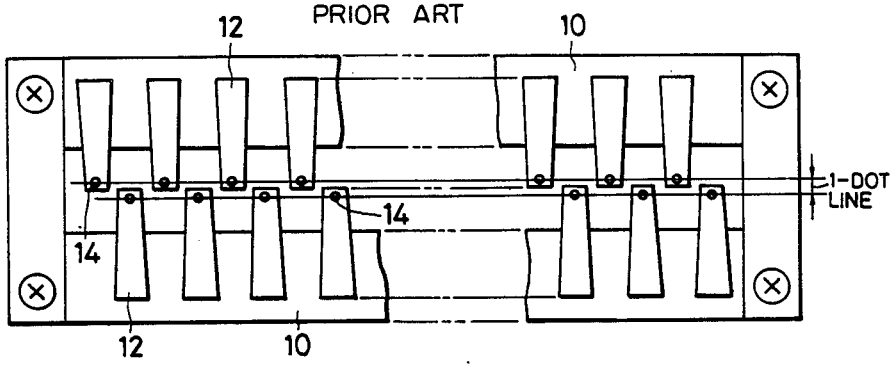
FIG. 5 PRIOR ART
Figure 6:
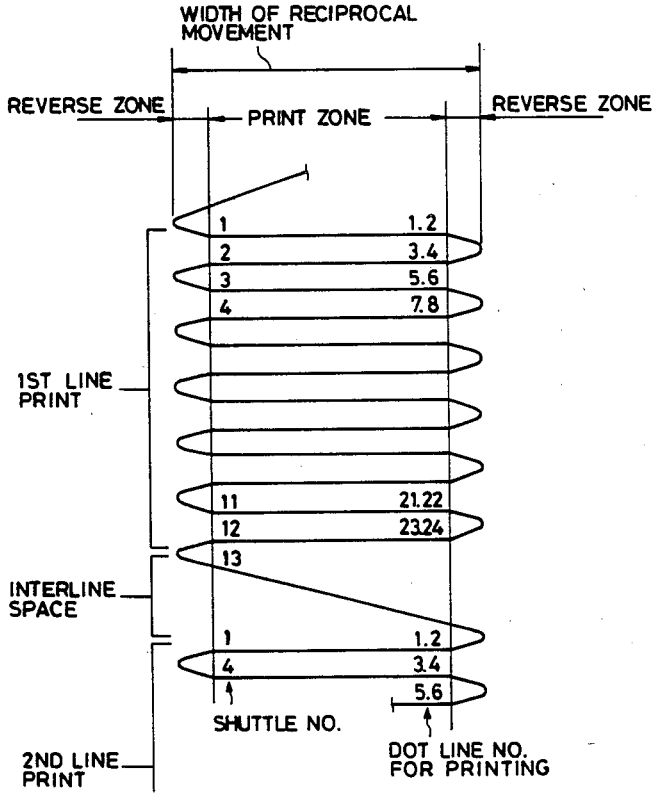
FIG. 6 PRIOR ART
FIG. 6 is a diagram showing a locus of printing pins for explaining the printing system using the hammer banks of FIG. 5.

Hammer banks 10 as illustrated in FIG. 5 and a printing method as will be explained herein with reference to FIG. 6 have been proposed for the purpose of reducing the required number of shuttle movements and of reducing the load applied to the shuttle mechanism 16. As is apparent from FIG. 5, printing pins 14 of one of the hammer banks 10 are provided so as to be separated by one dot-line from printing pins 14 of the other hammer bank 10. Accordingly, as is apparent from FIG. 6, two dot-lines are simultaneously printed by one shuttle movement and paper 8 is fed by two dot-lines in every reversing period. That is, actual printing of a character occurs over 12 shuttle movements and the paper feed between character lines occurs during the 13th shuttle movement. Therefore, one line of characters is printed using 13 shuttle movements. Assume now that the time for feeding paper over two dot-lines is 4 ms (the time for feeding paper over more than 2 dot-lines is about $\{4+0.5(n-2)\}$ ms, n being the number of dot-lines over which paper is fed). Then, the time required to print one line is about $(0.5\times27+4)\times13=227.5$ ms, so that the printing speed becomes about 264 lines per minute. In order to make the speed higher than the above-mentioned value, however, it is necessary to improve the hammer repeatability and to make the speed of the shuttle mechanism 16 higher. Accordingly, there have been the problems described above.

Figure 7:
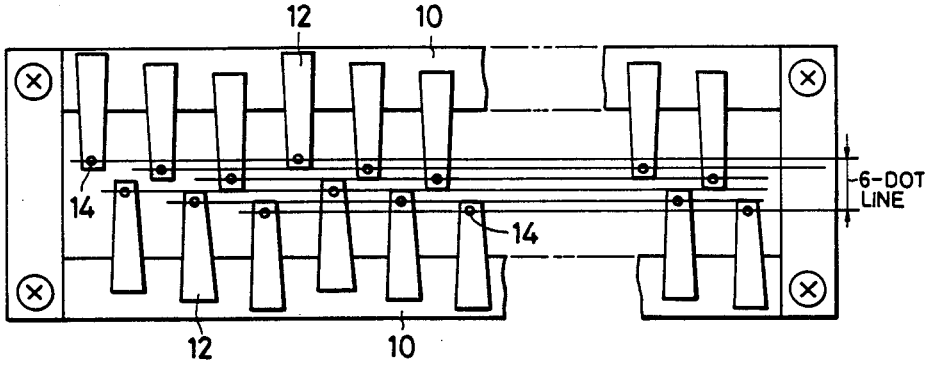
FIG. 7 is a front view showing an example of the hammer banks which may be used with the present invention.
Figure 8:
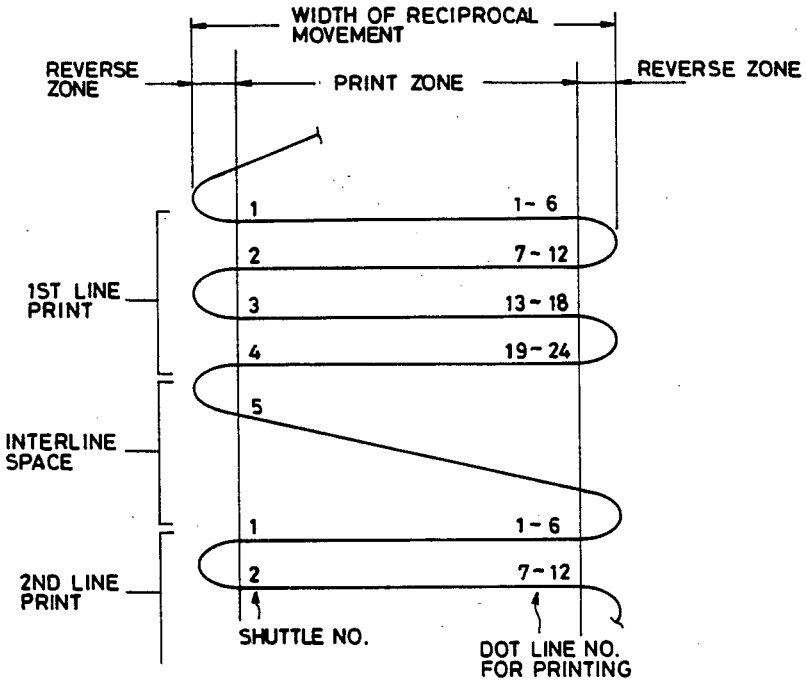
FIG. 8 is a diagram showing a locus of the printing pins for explaining a printing system using of the hammer banks of FIG. 7.

FIG. 7 shows an example of a hammer bank arrangement for use with the principles of the present invention. FIG. 8 is the locus of a printing pin useful in explaining an operation of the hammer banks illustrated in FIG. 7.

In the hammer bank arrangement of FIG. 7, the printing pins 14 at the upper and lower stages are grouped into sets each consisting of 6 printing pins such that in each printing pin set the uppermost and lowermost one of the 6 printing pins 14 extended upward and downward from the upper and lower hammer banks respectively are separated from each other by 6 dot-line. Three characters are printed by the 6 printing pins 14. Since 6 dot-lines are printed simultaneously by one shuttle movement, printing of one character line is accomplished with only 4 shuttle movements, and paper feeding between character lines is carried out by the 5th shuttle movement. In this printing method, the time taken for printing one line is about $(0.5\times81(=27\times3)+6)\times5=232.5$ ms, so that the printing speed is about 258 lines per minute, which is slower than that of the method used with the arrangement of FIG. 5. This is because an unnecessarily long time is allotted to the shuttle movement, as the time for one shuttle movement during which the paper is fed from one character line to the next is 46.5 ms (=232.5/5) and the quantity of paper feeding at that time is that of 12 dot-lines from the 19th dot-line of the line in question to the first dot-line of the succeeding character line.

As is apparent from the above description, by changing from the one dot-line printing method into the multi-dot-lines simultaneous printing method, it is possible to improve the printing speed by only about 10%. The speed can be made much higher only by improving the performance of the printing hammers, the paper feeding mechanism, and the shuttle mechanism. Such improvements are extremely difficult to effect and sometimes impossible.

Figure 9:
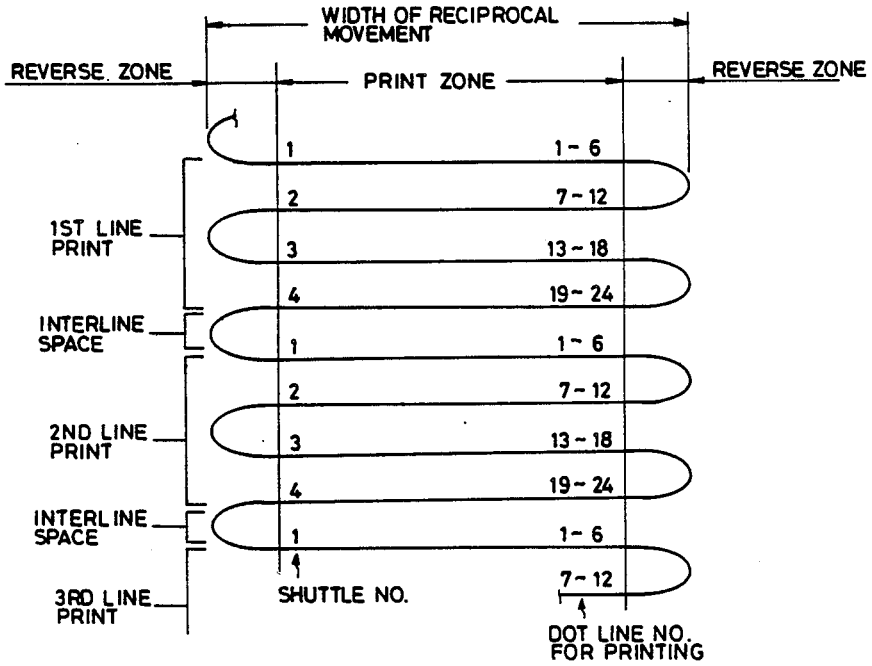
FIG. 9 is a diagram showing a locus of printing pins for explaining the printing system of the present invention.

The printing operation according to the teachings of the present invention will be described with reference to FIG. 9, the printing hammers being arranged as illustrated in FIG. 7. In the first shuttle movement, the printing pins 14 print 6 dot-lines from the first dot-line to the 6th dot-line, and paper feeding is made by 6 dot-lines in the reversing period of the shuttle movement. In the succeeding second shuttle movement, the printing pins 14 print the next 6 dot-lines from the 7th dot-line to the 12th dot-line, and paper feeding is made by six dot-lines in the reversing period of the second shuttle movement. Then, in the third shuttle movement, printing is made on the next 6 dot-lines from the 12th dot-line to the 18th dot-line and paper feeding is then made by six dot-lines. In the fourth shuttle movement, printing is made on the next 6 dot-lines from the 19th dot-line to the 24th dot-line and then paper feeding is made in the reversing period of the shuttle movement by 12 dot-lines from the 19th dot-line to the first dot-line of the succeeding line, so that the printing start position of the succeeding line is reached.

A shuttle mechanism 16 is defined so that the time of the reversing period is the minimum time for feeding paper by 12 dot-lines in carrying out paper feed between character lines. That is, if the shuttle mechanism 16 is made of a cam, the profile of the cam may be determined so as to satisfy the above-mentioned condition, while in the case where the shuttle mechanism 16 is, for example, a linear motor such as a voice coil motor, or the like, pulses or the like are applied to the motor control motor movement to provide the 12 dot-line movement.

Assuming that the time required for feeding paper by 12 dot-lines is 9 ms, the time required for printing one line is about $(0.5\times81+9)\times4=198$ ms, so that the printing speed is about 303 lines per minute.

According to the embodiment described above, increasing of the reversing period can greatly reduce the necessary acceleration in the accelerating/decelerating operation required during the reversing operation. Furthermore, the number of shuttle movements per unit time is reduced although the printing speed is increased. As a result, the load applied to the shuttle mechanism 16 is reduced, so that not only vibration and noise are reduced but the life and reliability of the shuttle mechanism 16 is improved. Still further, the printing quality is improved because accuracy of the dot-position printed on paper 8 is improved as vibration is reduced.

As any one printed character is formed of dots printed by at least 6 printing pins 14, the printed character can be effectively read even if any one of the printing pins 14 operates abnormally. Additionally, even in a continuous printing pattern of high-density characters of specific figures, the printing pins 14 take partial charge of dot printing so that the specific figures are scattered to the six ones or more of the printing pins 14, so that the duty cycle of the respective printing pins 14 can be equalized, resulting in improvement in reliability of the printer as well as in prolongation of the life of the hammer banks 10.

In the herein described embodiment of the invention, printing is simultaneous on 6 dot-lines and paper feeding is made over 6 dot-lines. However, the present invention is not limited to this case but substantially the same effects can be obtained if printing is made simultaneously on at least 3 dot-lines and paper feeding is made over the at least 3 dot-lines. Although the two hammer banks are provided on the two, upper and lower, stages, a plurality of rows of printing pins 14 may be provided on a single hammer bank.

In the embodiment described above, although printing of a Chinese character has been described by way of example, the embodiment can be similarly applied to the case of printing alphanumeric characters. In the case of alphanumeric character, one character is formed of 6 dot-positions on 12 dot-lines, in which actual printing is made at 5 dot-positions on 7 dot-lines while the remaining 1 dot-position on the printing 7 dot-lines is made to be an intercharacter space and the remaining non-printing 5 dot lines are made to be an interline space.

Accordingly, the printing pins are grouped into sets each consisting of 4 printing pins so that one character is printed by one set of 4 printing pins, 4 dot-lines are printed in the first shuttle movement, paper feeding is made over 4 dot-lines in the reversing period of the first shuttle movement, the next 4 dot-lines are printed in the succeeding second shuttle movement, and paper feeding is made over 8 dot-lines from the 5th dot-line to the first dot-line of the succeeding line in the reversing period of the second shuttle movement. Thus, paper feed between character lines can be carried out in the reversing periods as in the above described embodiment, so that the printing speed can be increased.

As described above, with the dot-line system of the present invention, the hammer bank reversing period is made longer than the time required to carry out the paper feed between character lines so as to carry out the paper feed entirely in the shuttle movement reversing period to thereby reduce the number of shuttle movements needed to complete printing of a character and move the paper to the first dot-line of the next character to be printed. Thus, not only can the printing speed be made higher, but the acceleration of the hammer banks in acceleration/deceleration operation during the reversing period can also be reduced. Additionally, the reversing period is made longer so that the printing paper comes to a complete stop in the reversing period so there is no possibility of any paper displacement during printing. This further improves the printing quality.

Moreover, variations in the characteristics of printing hammer operations can be reduced when the printing hammers are arranged as shown in the drawings, and thus the printing speed can be increased. Further increment of the printing speed can be achieved by making the operational characteristics of the hammers substantially even. Since the arrangement of the hammer is simplified, the dot line printer can be manufactured at inexpensive cost.

What is claimed is:

1. In a dot-line printer comprising a hammer bank carrying a plurality of dot-printing hammers separated from each other at predetermined intervals along a printing line, and a shuttle mechanism for causing said hammer bank to reciprocate with forward and backward shuttle movements along said printing line, wherein printing occurs as the hammer reciprocates, first means for feeding the paper over predetermined dot-means in the shuttle direction reversing period between successive shuttle movements and second means for feeding the paper after completion of a printed line to the first dot-line of the next line to be printed, there being a plurality of shuttle movements for printing each printing line, wherein the improvement comprises:

at least one group of printing hammers containing a predetermined number of printing hammers displaced from one another by predetermined numbers of dot-lines in a direction of paper feed, means for activating said predetermined number of printing hammers constituting said group to thereby simultaneously print a number of dots equal to said predetermined number of hammers, control means for controlling said first and second feed means and said shuttle mechanism such that the reversing period between successive shuttle movements is longer than the time required for carrying out the paper feed after completion of a printed line to the first dot-line of the next line to be printed, and the paper feed from the last printed dot-line of a printed line to the first dot-line of the next line to be printed takes place entirely during a reversing period, wherein the reversing period between shuttle movements is constant without regard to whether the reversing period is during the printing of a printed line or during the paper feed between printed lines, where the number of lines in which said paper is fed is greater between printed lines than during the printing of a printed line.

2. A dot-line printer for printing characters on character lines consisting of a predetermined number of dot-lines, there being a predetermined number of blank dot-lines between successive character lines comprising:

a hammer bank consisting of groups of printing hammers, there being a predetermined number of printing hammers in each group, the printing hammers of each group being displaced from one another by predetermined numbers of dot-lines;

a shuttle mechanism for causing said hammer bank to undergo reciprocating shuttle movements, there being a reversing period between successive shuttle movements;

paper feed means for feeding a paper over a predetermined number of dot-lines during each reversing period between shuttle movements for printing a character line, there being a plurality of shuttle movements for printing each character line, and for feeding the paper over said predetermined number of blank lines to first dot-line of the next character line to be printed after the preceding character line has been printed;

timing means for setting the duration of each shuttle movement and the duration of the reversing period and for indicating the presence of the reversing period, said timing means setting the reversing period to be longer than the time necessary for said feed means to feed said paper over said predetermined number of blank dot-lines to the first dot-line of the next character line to be printed; and said paper feed means including means responsive to said timing means indicating a reversing period after a predetermined number of shuttle movements for causing said paper to move over said predetermined number of blank dot-lines, wherein the reversing period between shuttle movements is constant without regard to whether the reversing period is during the printing of a printed line or during the paper feed between printed lines, where the number of lines in which said paper is fed is greater between printed lines than during the printing of a printed line.

3. The dot-line printer of claim 2 further including a plurality of hammer banks, each comprising at least one group of printing hammers.

* * * * *